US008672163B2

(12) United States Patent
Kim

(10) Patent No.: US 8,672,163 B2
(45) Date of Patent: Mar. 18, 2014

(54) REINFORCED PAPER LID

(76) Inventor: Yeong Leul Kim, Seoul (KR)

( * ) Notice: Subject to any disclaimer, the term of this patent is extended or adjusted under 35 U.S.C. 154(b) by 128 days.

(21) Appl. No.: 12/686,713

(22) Filed: Jan. 13, 2010

(65) Prior Publication Data

US 2010/0176130 A1 Jul. 15, 2010

Related U.S. Application Data

(63) Continuation-in-part of application No. PCT/KR2009/002450, filed on May 8, 2009.

(30) Foreign Application Priority Data

Jan. 14, 2009 (KR) ..... 10-2009-0003019

(51) Int. Cl.
*B65D 51/18* (2006.01)
*B65D 43/02* (2006.01)

(52) U.S. Cl.
CPC ..... *B65D 43/022* (2013.01); *B65D 43/0214* (2013.01)
USPC ..... 220/254.1; 220/796; 220/780

(58) Field of Classification Search
USPC ..... 220/796, 780, 619, 782, 794, 254.1; 229/125.13, 221
See application file for complete search history.

(56) References Cited

U.S. PATENT DOCUMENTS

| | | | | |
|---|---|---|---|---|
| 1,602,925 | A * | 10/1926 | Moore | 229/5.6 |
| 2,820,585 | A * | 1/1958 | Nerenberg et al. | 229/221 |
| RE28,797 | E | 5/1976 | Brewer | |
| 4,234,121 | A * | 11/1980 | Sasaki | 229/400 |
| 4,753,365 | A | 6/1988 | Seppala | |
| 5,197,624 | A * | 3/1993 | Dodaro | 220/254.3 |
| 5,752,614 | A * | 5/1998 | Nelson et al. | 220/276 |
| 5,901,902 | A * | 5/1999 | Grabher | 229/5.5 |
| 6,196,451 | B1 | 3/2001 | Helms | |
| 6,401,967 | B1 * | 6/2002 | Rabe et al. | 220/796 |
| 6,644,490 | B2 | 11/2003 | Clarke | |
| 6,679,397 | B2 | 1/2004 | Smith et al. | |
| 6,732,875 | B2 | 5/2004 | Smith et al. | |
| 6,772,901 | B2 * | 8/2004 | Witt | 220/276 |
| 6,874,649 | B2 | 4/2005 | Clarke et al. | |
| 7,131,551 | B2 | 11/2006 | Smith | |
| 7,134,566 | B2 | 11/2006 | Smith et al. | |
| 7,156,251 | B2 | 1/2007 | Smith et al. | |
| 7,159,732 | B2 | 1/2007 | Smith et al. | |
| 7,246,715 | B2 | 7/2007 | Smith et al. | |
| 7,703,626 | B2 * | 4/2010 | Witt | 220/276 |
| 7,938,293 | B2 * | 5/2011 | Gidumal | 220/796 |
| 2002/0170914 | A1 * | 11/2002 | Witt | 220/276 |
| 2006/0201946 | A1 * | 9/2006 | Witt | 220/276 |
| 2007/0210091 | A1 * | 9/2007 | Mazzarolo | 220/643 |

* cited by examiner

*Primary Examiner* — Robert J Hicks
*Assistant Examiner* — Kareen Rush
(74) *Attorney, Agent, or Firm* — IM IP Law PLLC; C. Andrew Im

(57) ABSTRACT

The paper lid comprises a top plate, a sidewall formed downward at an edge of the top plate, and a reinforcing member to reinforce the sidewall and firmly attach the paper lid to a container. Further, the paper lid comprises a receipt part is formed between an inner top of the reinforcing member and the top plate. The receipt part grasps the rim of the container, thereby strengthening the connection between the paper lid and the container.

13 Claims, 5 Drawing Sheets

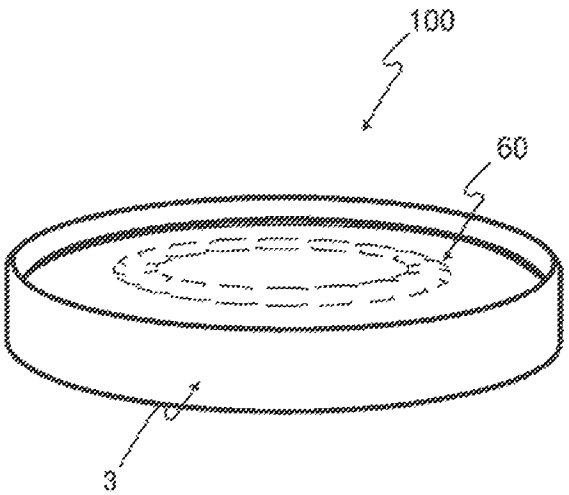
Fig.6-B
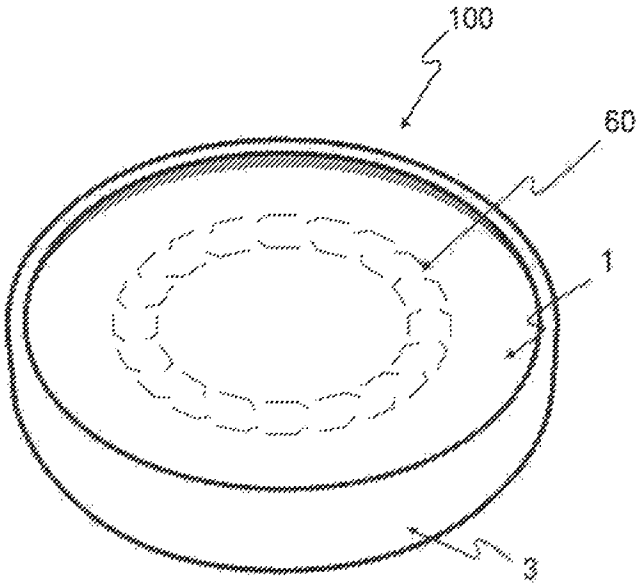
Fig.6-A

REINFORCED PAPER LID

RELATED APPLICATION

This application is a continuation-in-part of international application PCT/KR2009/002450 filed May 8, 2009 which claims priority from Korean Patent Application No. 10-2009-0003019 filed Jan. 14, 2009, each of which is herein incorporated by reference in its entirety.

FIELD OF THE INVENTION

The present invention relates to a paper lid or cover used for cups and soup bowls, and more particularly to a lid made of paper.

DESCRIPTION OF THE RELATED ART

In general, transparent or semitransparent plastic caps are used as lids, covers or caps for all take-out or indoor cups and bowls including plastic, Styrofoam and paper cups for beverages, such as coffee, tea, ice cream and the like, and plastic, Styrofoam and paper bowls for soups, cereals and the like. Since these plastic caps/lids/covers are thrown away after a single use, they cause not only environmental contamination but also have high associated manufacturing cost in part due to rising oil prices.

Accordingly, the use of a paper lid is highly desirable over the plastic lid because paper products decompose more readily, thereby reducing environmental contamination. Also, paper lid can be manufactured without using petroleum-based products.

In the same manner as the conventional plastic lid, the paper lid for a container (e.g., beverage cup and/or a bowl) need to be hygienic and waterproofed. Further the paper lid needs to maintain restoring force with flexibility while not being torn when it is handled by the operator to open and close the beverage cup or bowl several times. Thus, the paper lid can be utilized and replace the plastic lid as long as it satisfies these exemplary requirements, i.e., the lid is well fitted to a body of a container when it is closed so that the fluid (e.g., beverage, soup, etc.) within the container does not overflow due to shaking during carriage, and the lid does not expand or contract based on the temperature.

However, currently available paper lids do not satisfy these requirements and so far have been unable to replace these environmentally unfriendly plastic lids. The currently available paper lids cannot be firmly fitted to the container (e.g., cup or bowl) to provide a tight seal due to a weak sidewall of the paper lid. Further, the currently available paper lids cause overflow slippage of the fluid (e.g., beverage or soup) in the container due to slight shaking. Thereby, the claimed invention proceeds upon the desirability of providing environmentally friendly paper lids satisfying the above-referenced requirements than easily substitute and replace the environmentally unfriendly plastic lids.

SUMMARY OF THE INVENTION

Therefore, it is an object of the claimed invention to provide a paper lid for use with containers (e.g., cups and bowls), which overcomes above-noted shortcomings of the conventional paper lids.

It is another object of the claimed invention to provide a paper lid, which has an improved strength of a sidewall thereof and can be firmly fitted to a container to prevent the paper lid from being easily taken off from the container, thereby preventing overflow spillage of fluids (such as drink, soup and the like) from the container during transit, thereby facilitating the substitution of environmentally unfriendly plastic lids that are currently used with paper containers.

In accordance with an aspect of the present invention, the above and other objects can be accomplished by the provision of a paper cap including a top plate, and a sidewall formed downward at an edge of the top plate, wherein the sidewall is reinforced with a reinforcing member. The reinforcing member may be a tape having a U-shaped longitudinal section, and the sidewall may be inserted into a central groove of the U-shaped tape. Further, a receipt part may be formed between an inner top of the reinforcing member and the top plate.

Moreover, a cutting line may be formed on the top plate so that, when a user drinks a beverage, the user removes a cutting part along the cutting line and thus forms a hole on the top plate. The cutting line may be formed in two stages such that the size of the hole may be adjusted according to a drinking amount to be required.

BRIEF DESCRIPTION OF THE DRAWINGS

The above and other objects, features and other advantages of the present invention will be more clearly understood from the following detailed description taken in conjunction with the accompanying drawings, in which:

FIGS. 6A and 6B are top and side perspective views of the vented paper lid in accordance with an exemplary embodiment of the claimed invention;

FIGS. 7-1 to 7-7 show perspective views of the paper lid with a removable opening part for use with a beverage cup in accordance with an exemplary embodiment of the claimed invention; and FIG. 8 is a perspective view of a non-circular paper lid in accordance with an exemplary embodiment of the claimed invention.

DETAILED DESCRIPTION OF THE EMBODIMENTS

Hereinafter, preferred embodiments of the present invention will be described in detail with reference to the annexed drawings.

Figure 1:
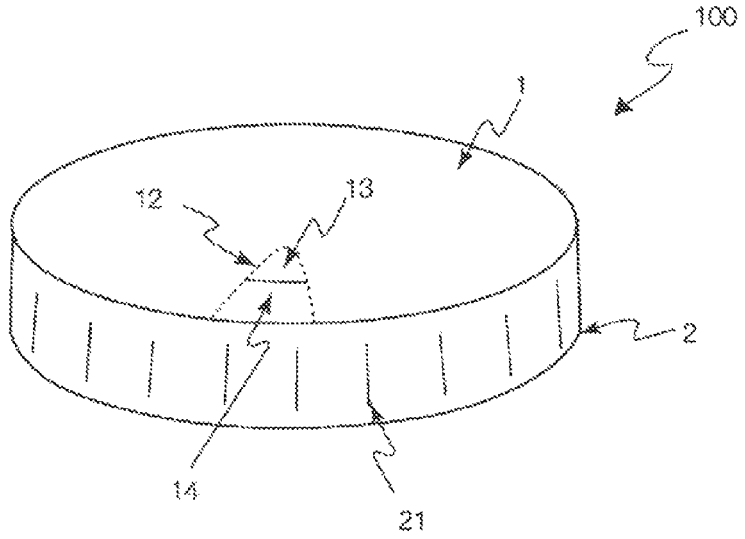
FIG. 1 is a perspective view of a paper lid with a sidewall formed by folding a peripheral portion of a top plate at notches located on the peripheral portion of the plate as shown in FIG. 5.

Turning now to FIGS. 1 and 8, a paper lid 100 in accordance with an exemplary embodiment of the claimed invention comprises a top plate 1 having an outer surface 50 and an inner surface 51, and a sidewall 2 formed downward at an edge of the top plate 1 and reinforced with a reinforcing member 3. It is appreciated that one surface or both surfaces 50, 51 of the paper lid 100 can be coated with synthetic resin.

Figure 5:
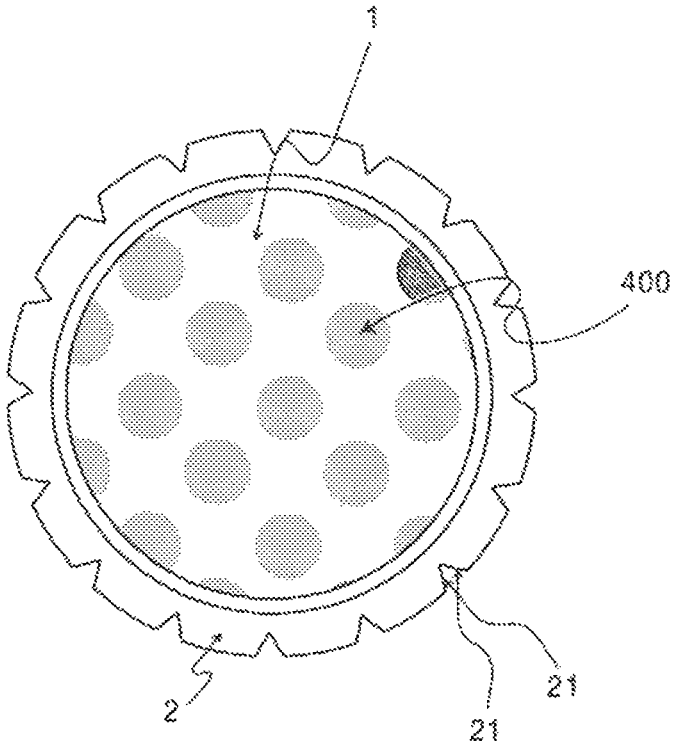
FIG. 5 is a perspective view of top plate with notches located on its peripheral in accordance with an exemplary embodiment of the claimed invention.

In accordance with an exemplary aspect of the claimed invention, as shown in FIG. 5, the sidewall 2 is formed by folding/bending the outer peripheral portion of the top plate 1 downward at the notches 21. Alternatively, the sidewall 2 can be formed by bonding a separate wall member to the top plate 1. It is appreciated that the top plate 1 can be used to form a circular paper lid 100 as exemplary shown in FIG. 1 and a non-circular paper lid 100, such as a rectangular shaped paper lid 100 as shown in FIG. 8. The top plate 1 can be folded/bended to form any shaped paper lid 100 in accordance with an exemplary embodiment of the claimed invention.

Figure 2:
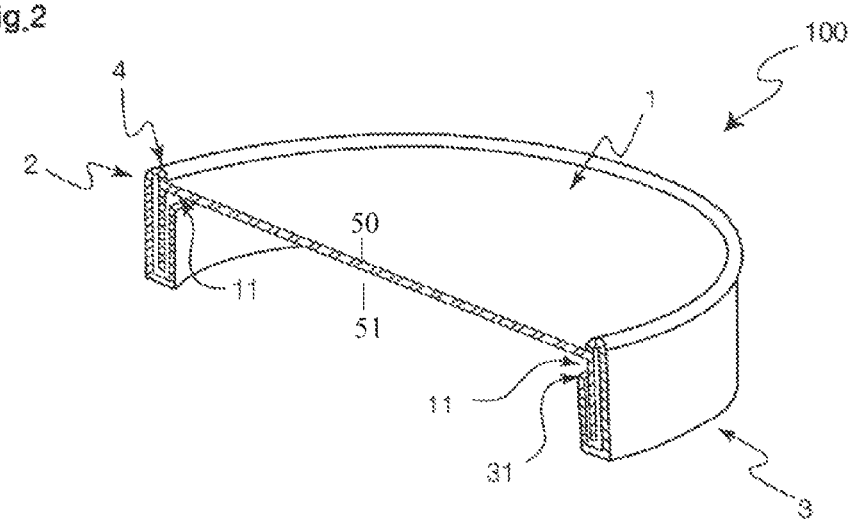
FIG. 2 is a partially tom-off exploded view of a paper lid with a reinforcing member in accordance with an exemplary embodiment of the claimed invention.
Figure 3:
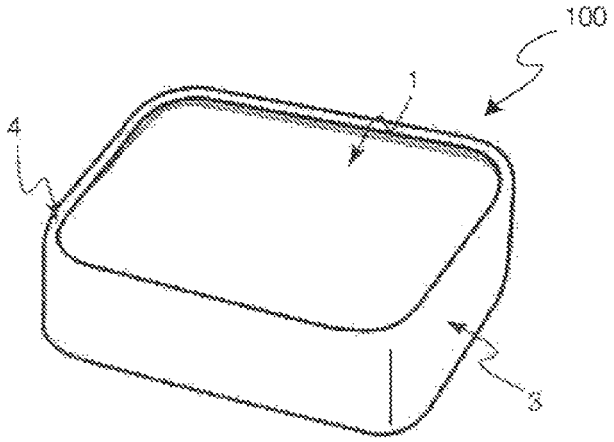
FIG. 3 is a longitudinal-sectional view illustrating the paper lid in accordance with an exemplary embodiment of the claimed invention firmly secured to a container.
Figure 3:
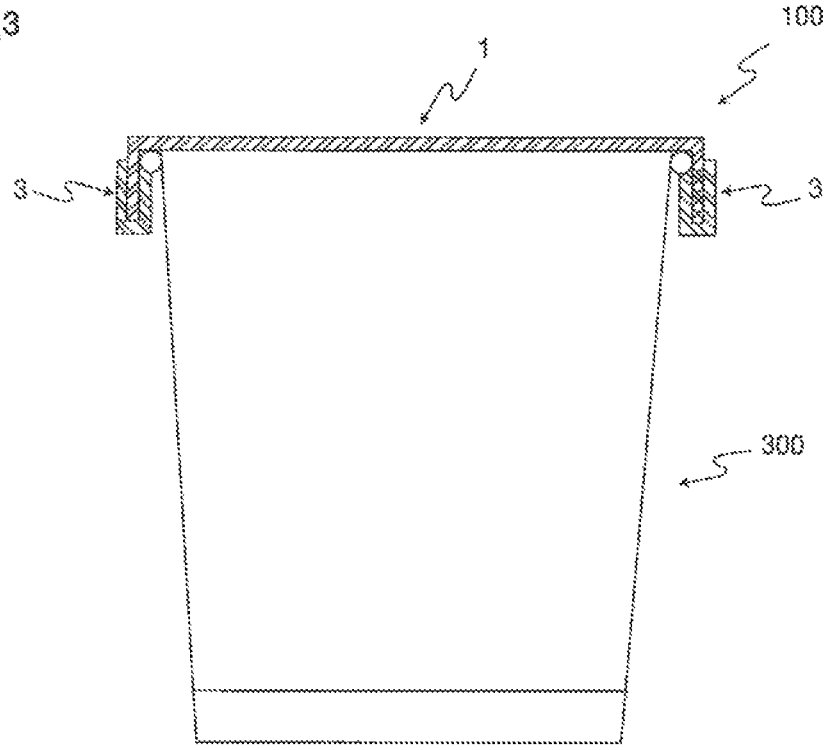

As shown in FIG. 2, in accordance with an exemplary embodiment of the claimed invention, the reinforcing member is a tape 3 having a U-shaped longitudinal section. The sidewall 2 of the paper lid is inserted into a central groove of the U-shaped tape 3. Further, as shown in FIGS. 2-4, a receipt part 11 for securely fitting top section of the container 300 is formed between an inner top 31 of the U-shaped tape 3 and the top plate 1.

Turning now back to FIG. 1, in accordance with an exemplary embodiment of the claimed invention, a cutting line 12 is formed on the top plate 1 of the paper lid 100 for a beverage cup. When a user want to drink the beverage in the paper cup 300 that is secured by the claimed paper lid 100, the user can remove a cutting part 13 along the cutting line 12, thereby forming a hole 14 on the top plate 1. Preferably, the cutting line 12 is formed in two stages such that the size of the hole 14 can be adjusted according to the user's preference and amount of beverage to be dispensed.

Figure 4:
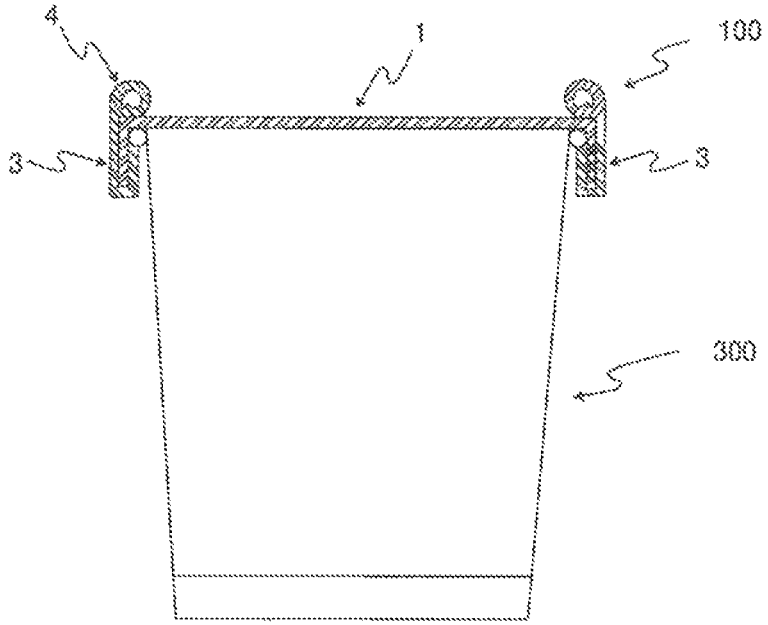
FIG. 4 is a longitudinal-sectional view illustrating the paper lid in accordance with an exemplary embodiment of the claimed invention firmly secured to a container.

Turning now to FIG. 4, in accordance with an exemplary embodiment of the claimed invention, an outer top of the U-shape tape 3 of the paper lid 100 can be extended to an area above the top plate 1, thereby forming a rolling part 4 on the extended outer top of the U-shaped tape 3. Such a paper lid 100 can provide a user with a soft tactile sensation, when the user grasps the paper cap, and is highly marketable. Further, the rolling part 4 additionally strengthens the sidewall 2 of the paper lid 100 and contains any leakage or spillage within the top plate 1, thereby minimizing any leakage down the side of the cup 300 and onto the user's hand holding the cup 300. Furthermore, the rolling part 4 allows the paper lid 100 to be stacked, thereby providing efficient storage of the paper lids 100.

As apparent from the above description, the claimed invention provides a paper lid 100, in which a sidewall 2 is reinforced with a reinforcing member 3 to firmly cover a container 300 (e.g., a cup or bowl) with the paper lid 100, thereby preventing the side wall 2 from buckling or wavering, thereby preventing the paper lid 100 from being easily taken off from the container 300. Particularly, if the reinforcing member 3 has a shorter length than the circumference of the top plate, the circumference of the lower end of the paper lid 100 is reduced, and thus it is possible to prevent the paper lid 100 from being taken off from the container 300.

Further, in accordance with an exemplary embodiment of the claimed invention, the top plate 1 and the reinforcing member 3 of the paper lid 100 forms a receipt part 11, as shown in FIGS. 1-3. The receipt part 11 receives the rim of the container 30 or grasps the circumference of the top end of the container 300 and thus strengthens the connection between the paper lid 100 and the container 300, thereby not only preventing the paper lid 100 from being taken off from the container 300 but also preventing a beverage or soup in the container 300 from overflowing even if the container 300 is shaken. The reinforcing member 3 and the receipt part 11 of the claimed paper lid 100 allow the user to reuse the paper lid 100 number of times. That is, the container 300 can be closed and opened multiple times using the same paper lid 100 without tearing because of the reinforced sidewall 2, 3 and the receipt part 11 for firmly securing the paper lid 100 to the container 300. Moreover, the reinforced sidewall 2, 3 and receipt part 11 minimizes any potential spillage or leakage down the side of the cup 300.

It is appreciated that the paper lid 100 comes in variety of sizes to fit any sized cups and bowls. The reinforced sidewall 2, 3 of the claimed paper lid 100 permits that paper lid 100 to be used to firmly seal cold or hot items in the container 300 and retrieve the cold or hot items from the container 300 without weakening or tearing the sidewall 2, which is common with the conventional paper lid.

In accordance with an exemplary embodiment of the claimed invention, a cutting line 12 formed on the top plate 1 of the paper lid 100 for a cup 300 allows the size of a hole 14, formed by removing a cutting part 13 along the cutting line 12, to be adjusted according to the user's preference and amount of beverage to be dispensed.

In accordance with an exemplary embodiment of the claimed invention, logos, lettering, designs 400 can be printed on the top plate 1 of the paper lid 100, which is difficult to do with the conventional plastic lids.

Turning now to FIGS. 6A-B, there are illustrated perspective views of the paper lid 100 comprising a plurality of cutting lines or slits 60 on the top plate 1 to vent steam from the sealed container 300 (not shown) containing hot items, e.g., hot soup, hot food, hot coffee, etc. The plurality of slits 60 are preferably cut by depressing a cutting instrument from an inner portion to the outer portion of the top plate 1, thereby providing passages to vent steam yet minimizing a spillage of the content (such as a drink, soup and the like) from the sealed container 300. Preferably, the plurality of slits 60 can form a pattern as shown in FIGS. 6A-B.

Figures 1, 2, 3, 4, 5, 6, 7:
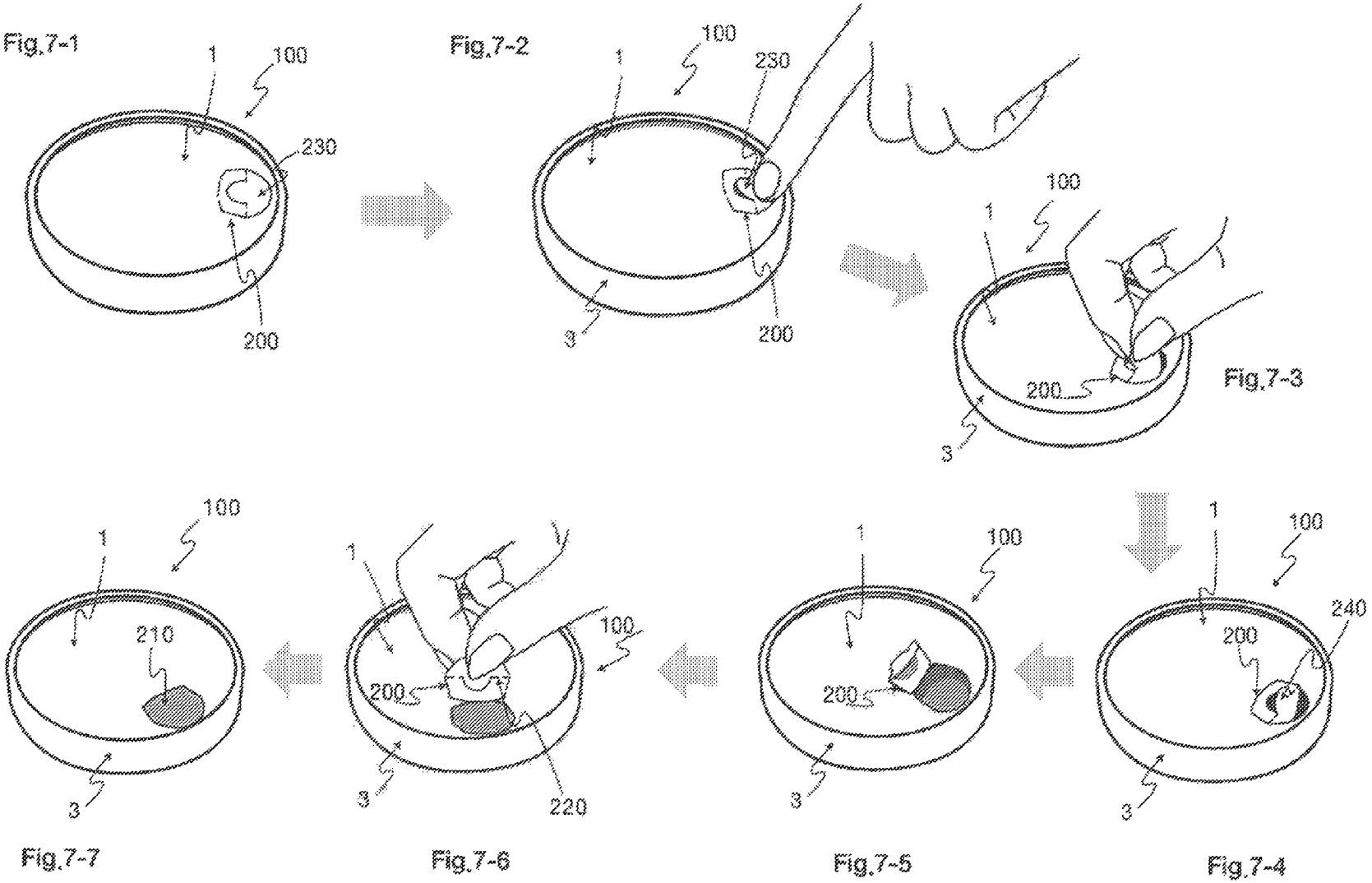

Turning now to FIG. 7, there is illustrated perspective views of the paper lid 100 with a removable opening part 200 on the top plate 1 for use with a beverage container 300 (not shown) in accordance with an exemplary embodiment of the claimed invention. The solid lines framing the removable opening part 200 is preferably die-cut line, except dashed line 220 representing a fold line. When a user want to drink the beverage in the cup 300 that is secured by the claimed paper lid 100, as shown in FIGS. 7-2 and 7-3, the user can depress a front portion that is close to the reinforced sidewall 2, 3 to fold the removable opening part 200 on the fold line 220, thereby forming an opening 210 on the top plate 1, as shown in FIG. 7-4. The opening 210 can be increased by removing the entire removable opening part 200 as shown in FIGS. 7-5 and 7-6. The front portion of the removable opening part 200 preferably has a tab 240 for pulling the entire removable opening part 200 from the top plate 1, as shown in FIGS. 7-3 to 7-6.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A reinforced paper lid having a lower end and an upper end, comprising:

a top plate comprising a sidewall portion comprising a plurality of notches at a perimeter of said top plate to facilitate bending of said top plate at the perimeter and a remaining top portion;

a reinforcing member having a circumference shorter than a circumference of the remaining top portion of the top plate; and a sidewall formed downward at the perimeter of the top plate by bending the sidewall portion of the top plate into the reinforcing member and shortening the circumference of the sidewall portion of the top plate to be less than the circumference of the remaining top portion using said plurality of notches to fit into the shorter reinforcing member and to provide an inward angled reinforced sidewall such that a circumference of the reinforced paper lid at its lower end is shorter than a circumference of the reinforced paper lid at its upper end.

2. The paper lid of claim 1, wherein said reinforcing member is a tape having a U-shaped longitudinal section; and wherein the sidewall is inserted into a central groove of the U-shaped longitudinal section of said tape.

3. The paper lid of claim 1, wherein said top plate comprises a plurality of slits to vent steam from said container.

4. The paper lid of claim 3, wherein said plurality of slits forms a pattern.

5. The paper lid of claim 3, wherein said plurality of slits are depressions from an inner surface to an outer surface of said top plate.

6. The paper lid of claim 1, wherein said top plate comprises a printed design or logo.

7. The paper lid of claim 1, further comprising a removable opening part on said top plate.

8. The paper lid of claim 7, wherein said removable opening part comprises a front portion that can be depressed by a user to partially remove said removable opening part from said top plate to form an opening on said top plate.

9. The paper lid of claim 8, wherein said front portion of said removable opening part comprises a tab that can be pulled by said user to entirely remove said removable opening part from said top plate.

10. The paper lid of claim 1, wherein the paper lid varies in size to fit varying size of said container.

11. The paper lid of claim 1, wherein said container is one of the following: a cup or a bowl.

12. The paper lid of claim 1, wherein said top plate forms a circular paper lid.

13. The paper lid of claim 1, wherein said top plate forms a non-circular paper lid.

* * * * *